US006431907B1

(12) United States Patent
Ma

(10) Patent No.: US 6,431,907 B1
(45) Date of Patent: Aug. 13, 2002

(54) FPC CONNECTOR WITH POSITIONING ACTUATOR

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/874,748

(22) Filed: Jun. 4, 2001

(51) Int. Cl.[7] ..... H01R 13/15
(52) U.S. Cl. ..... 439/495; 439/260
(58) Field of Search ..... 439/495, 260, 439/329

(56) References Cited

U.S. PATENT DOCUMENTS 4,778,403 A * 10/1988 Ikesugi et al. ..... 439/495
5,458,506 A * 10/1995 Yamaguchi et al. ..... 439/495
5,476,393 A * 12/1995 Narita ..... 439/495
5,580,272 A * 12/1996 Yamaguchi et al. ..... 439/495
6,089,905 A * 7/2000 Shimmyo et al. ..... 439/495
6,203,345 B1 * 3/2001 Roque et al. ..... 439/495
6,224,418 B1 * 5/2001 Miura et al. ..... 439/495
6,267,620 B1 * 7/2001 Ma ..... 439/495
6,280,217 B1 * 8/2001 Lin ..... 439/495
6,283,779 B1 * 9/2001 Lung ..... 439/495

* cited by examiner

*Primary Examiner*—Gary F. Paumen
(74) *Attorney, Agent, or Firm*—Wei Te Chung

(57) ABSTRACT

An electrical connector includes: an insulative housing comprising opposite side walls and an interior space formed there between for receiving a flexible circuit, a spring arm and a inner spacer formed near each other on each side wall, a slot formed in each spring arm, a slit formed between each spring arm and inner spacer, a projection extending forward from a back surface of the slit, and a recess formed under each projection; a plurality of contacts being secured in the housing, each contact having a contact portion extending into the interior space of the housing; and an actuator comprising an elongate bar and two arms extending from opposite ends of the elongate bar, each arm having a pivot pin inserted into the sloton the side wall and a pitch pin received into the recess for maintaining the actuator at an open position.

1 Claim, 9 Drawing Sheets

FPC CONNECTOR WITH POSITIONING ACTUATOR

BACKGROUND OF THE INVENTION

1. Field of The Invention

The present invention relates to an electrical connector that can connect a Flexible Printed Circuit (FPC) with a printed circuit board, and particularly to an electrical connector with an actuator which can be maintained at certain position.

2. Brief Description of The Prior Art

A flexible circuit connector connects a flexible circuit board to a rigid circuit board. The flexible circuit connector comprises an insulative housing mounted to the rigid circuit board. A plurality of grooves is defined in the housing for receiving and retaining conductive contacts electrically connected to the rigid circuit board. An opening is defined in the housing in communication with the grooves of the housing for receiving an end portion of a flexible circuit whereby conductive traces printed on the flexible circuit board may electrically engage the contacts. An actuator is attached to the housing for securing the flexible circuit to the connector. The actuator is movably mounted to the housing to operate between an open position where a space is present between the actuator and the housing for the insertion of the flexible circuit and a closed position where the actuator engages and applies a force on the flexible circuit to secure the flexible circuit between the actuator and the housing and ensure proper electrical connection between the flexible circuit and the contacts.

Referring to FIG. 1, a conventional flexible circuit connector 1' comprises a housing 2', contacts 3', and an actuator 4'attached to the housing 1'. The actuator 4' can move between open and closed positions. When at the open position, however, the actuator 4' will tend to move without control, and may even be damaged. Examples of electrical connectors with similar structures are those disclosed in U.S. Pat. Nos. 4,778,403, 5,458,506, and 5,580,272.

Hence, an improved electrical connector is required to overcome the disadvantages of the prior art.

BRIEF SUMMARY OF THE INVENTION

The object of the present invention is to provide an electrical connector capable of securely maintaining an actuator thereof at certain position with respect to an insulative housing thereof.

To achieve the above-mentioned object, a connector in accordance with the present invention includes an insulative housing comprising opposite side walls and an interior space formed there between for receiving a flexible circuit, a spring arm and an inner spacer formed near each other on each side wall, a slot formed in each spring arm, a slit formed between each spring arm and inner spacer, a projection extending forward from a back surface of the slit, and a recess formed under each projection; a plurality of contacts being secured in the housing, each contact having a contact portion extending into the interior space of the housing; and an actuator comprising an elongate bar and two arms extending from opposite ends of the elongate bar, each arm having a pivot pin inserted into the sloton the side wall and a pitch pin received into the recess for maintaining the actuator at an open position.

Other objects, advantages and novel features of the present invention will become more apparent from the following detailed description of the present embodiment when taken in conjunction with the accompanying drawings.

DETAILED DESCRIPTION OF THE INVENTION

Figure 1:
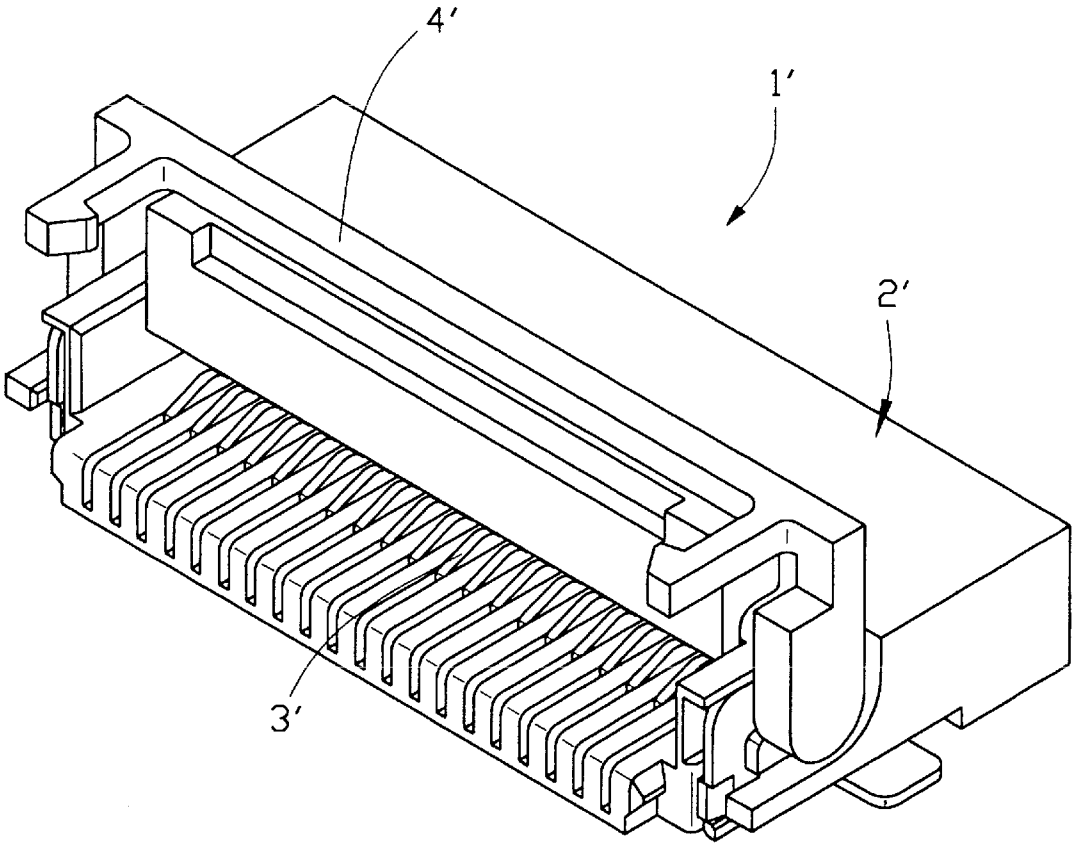
FIG. 1 (PRIOR ART)
FIG. 1 is a perspective view of a conventional flexible circuit connector at an open position.
Figure 2:
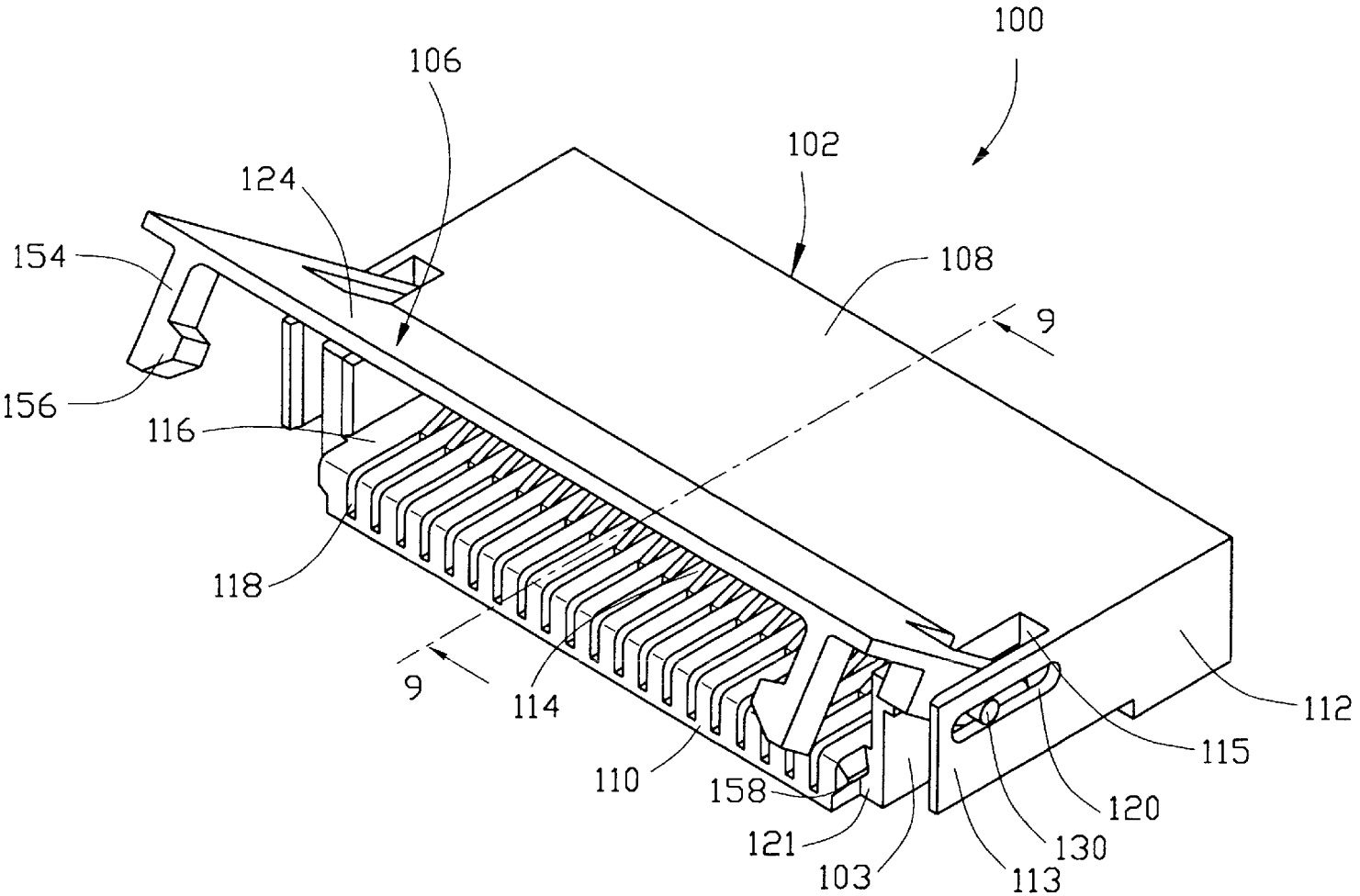
FIG. 2 is a perspective view of a flexible circuit connector in accordance with an embodiment of the present invention at an open position.
Figure 3:
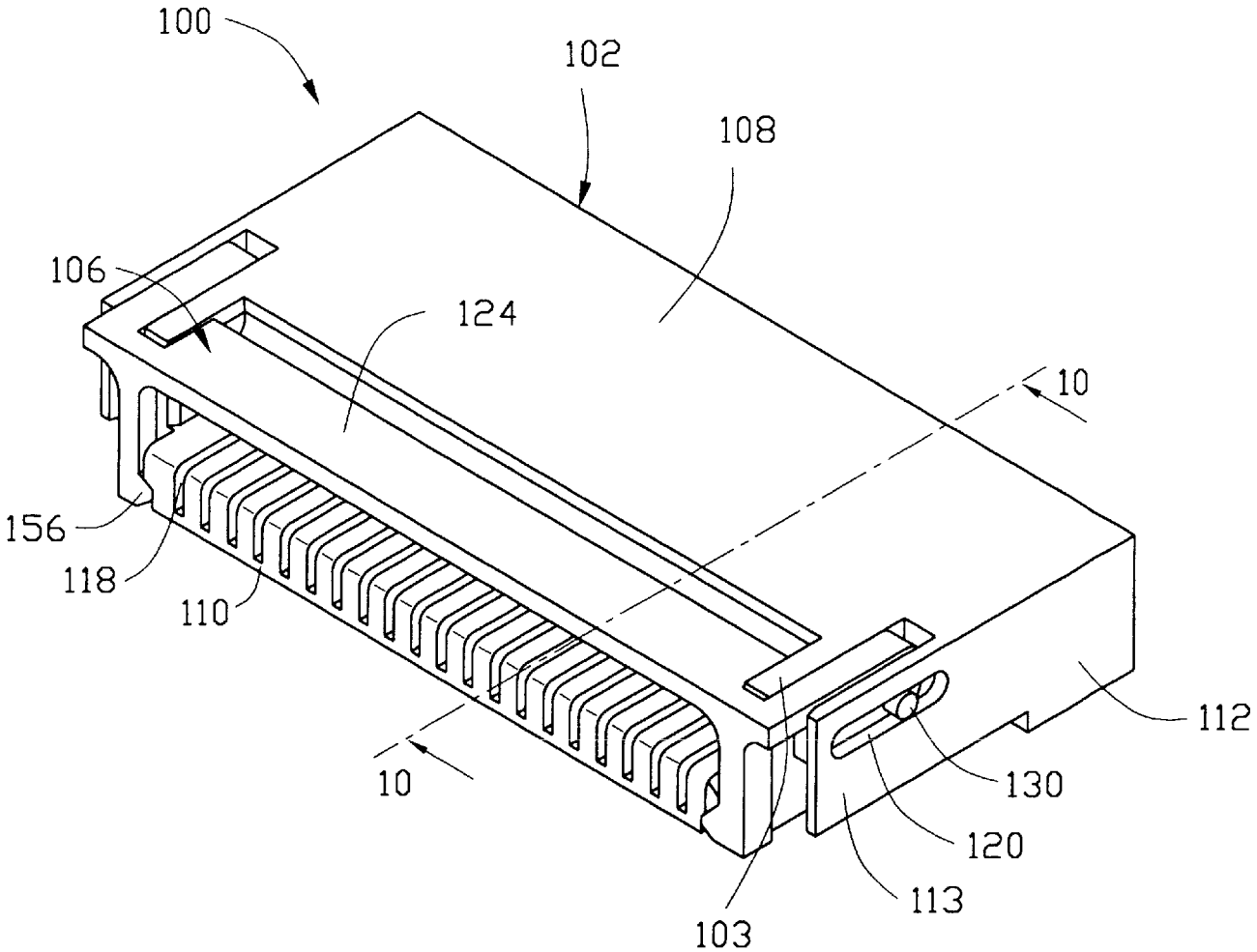
FIG. 3 is a view similar to FIG. 2 but showing the flexible circuit connector at a closed position.

Referring to FIG. 2 and FIG. 3, the FPC connector 100 in accordance with the present invention comprises a housing 102 for receiving a plurality of electrical contacts 104 therein and a moveable actuator 106 made of insulative material and pivotally attached to the housing 102 for moving with respect thereto between an open position (see FIG. 2) and a closed position (see FIG. 3).

Figure 4:
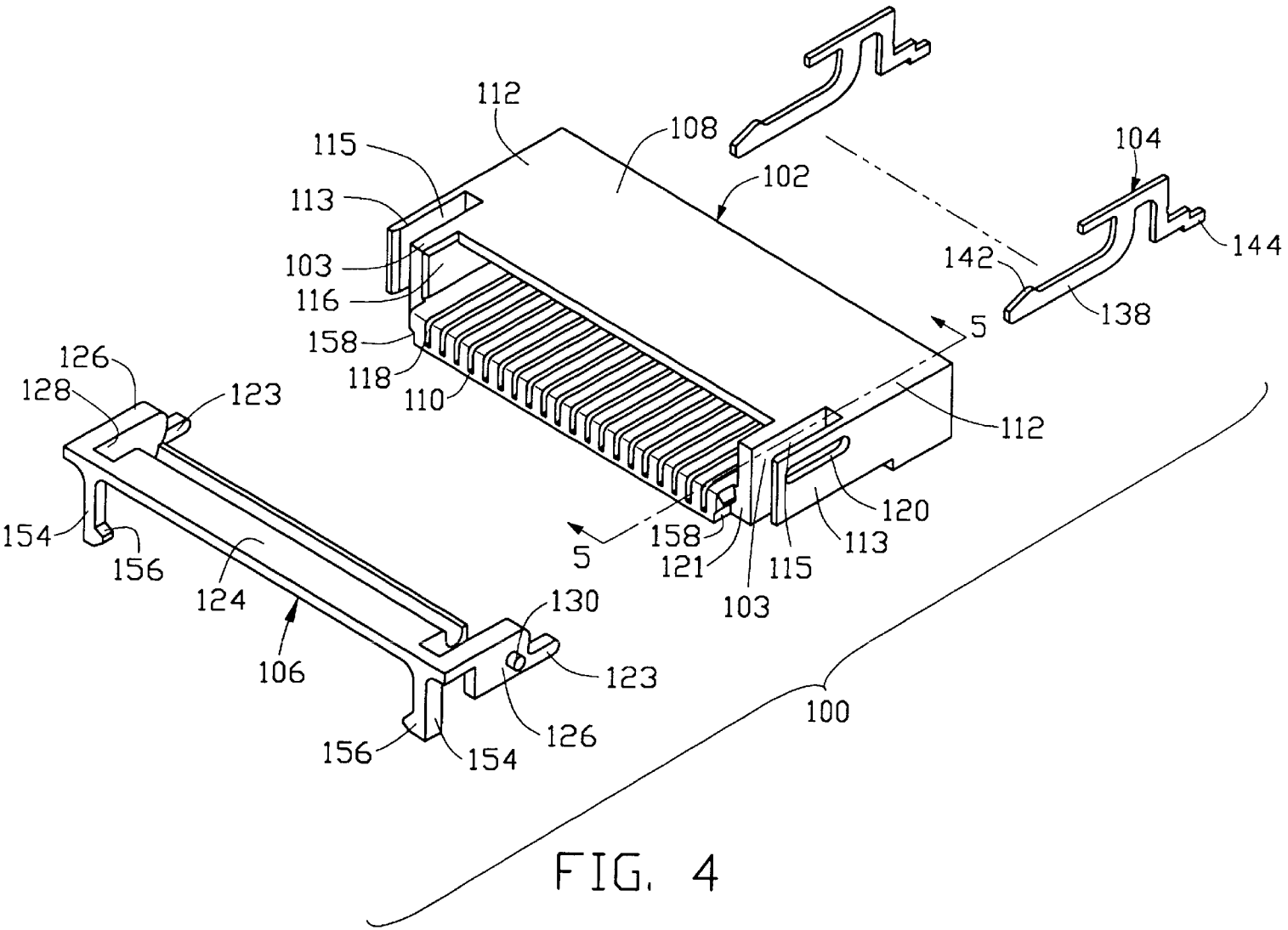
FIG. 4 is an exploded view of the flexible circuit connector of FIG. 2.

Referring to FIG. 4, the housing 102 comprising horizontally extending top wall and bottom wall 108, 110 connected by opposite, vertically extending side-walls 112 for defining an interior space 114 having a forward opening 116, a plurality of receiving grooves 118 is defined in the bottom wall 110 each in communication with the interior space 114 for receiving the contacts 104 therein.

Figure 5:
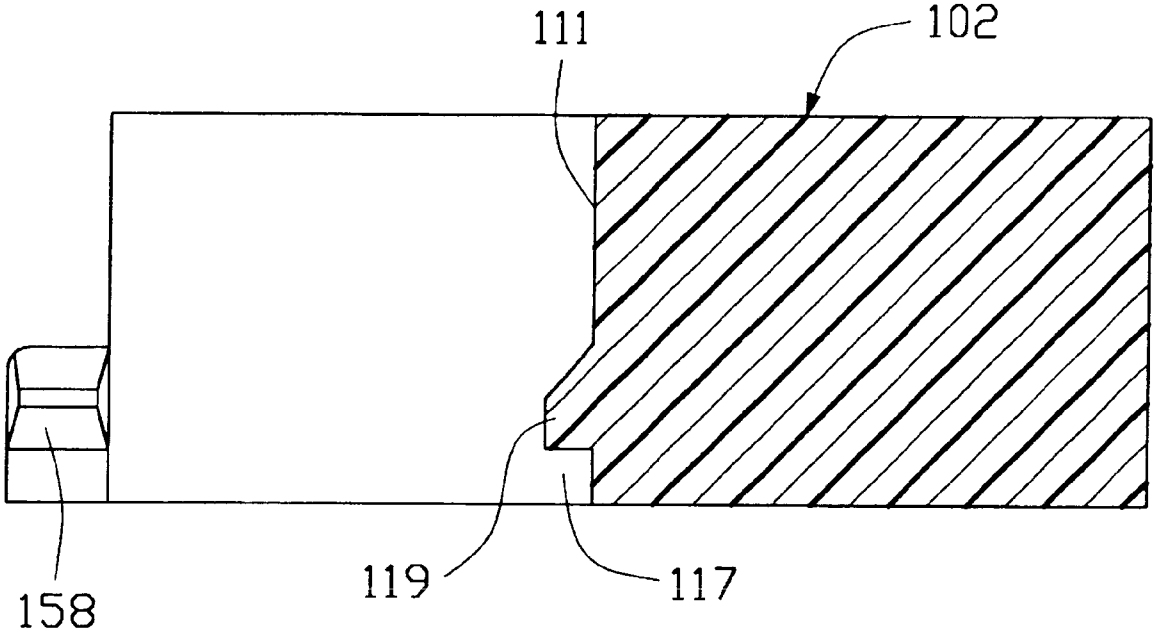
FIG. 5 is a cross-sectional view taken along line 5—5 of FIG. 4.

As best seen in FIGS. 4 and 5. Each side wall 112 includes a spring arm 113 and an inner spacer 103 parallelly extending there from, and a pivot-receiving slot 120 formed in the spring arm 113 and extending there through. The inner spacer 103 includes a front end 121. A slit 115 extends backwardly between each spring arm 113 and inner spacer 103. A projection 119 extends forward from a back surface 111 of the slit 115. A recess 117 is formed under each projection 119 for receiving the actuator 106.

Figure 6:
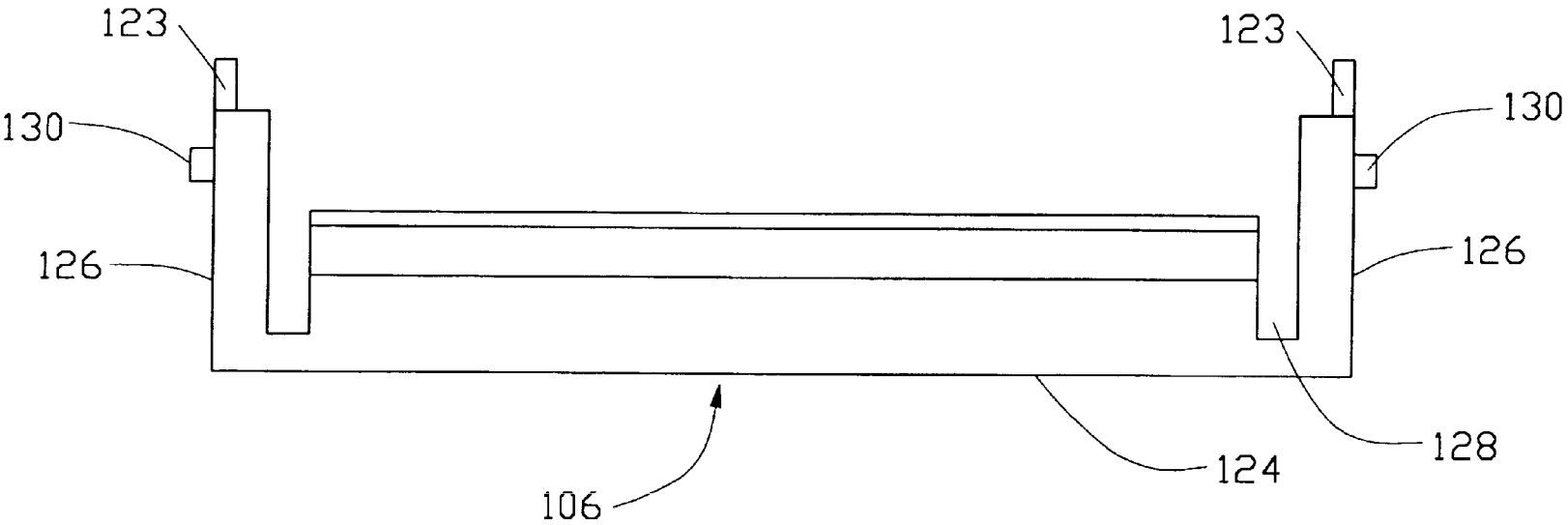
FIG. 6 is a top plan view of the actuator of the flexible circuit connector of the present invention.
Figure 7:
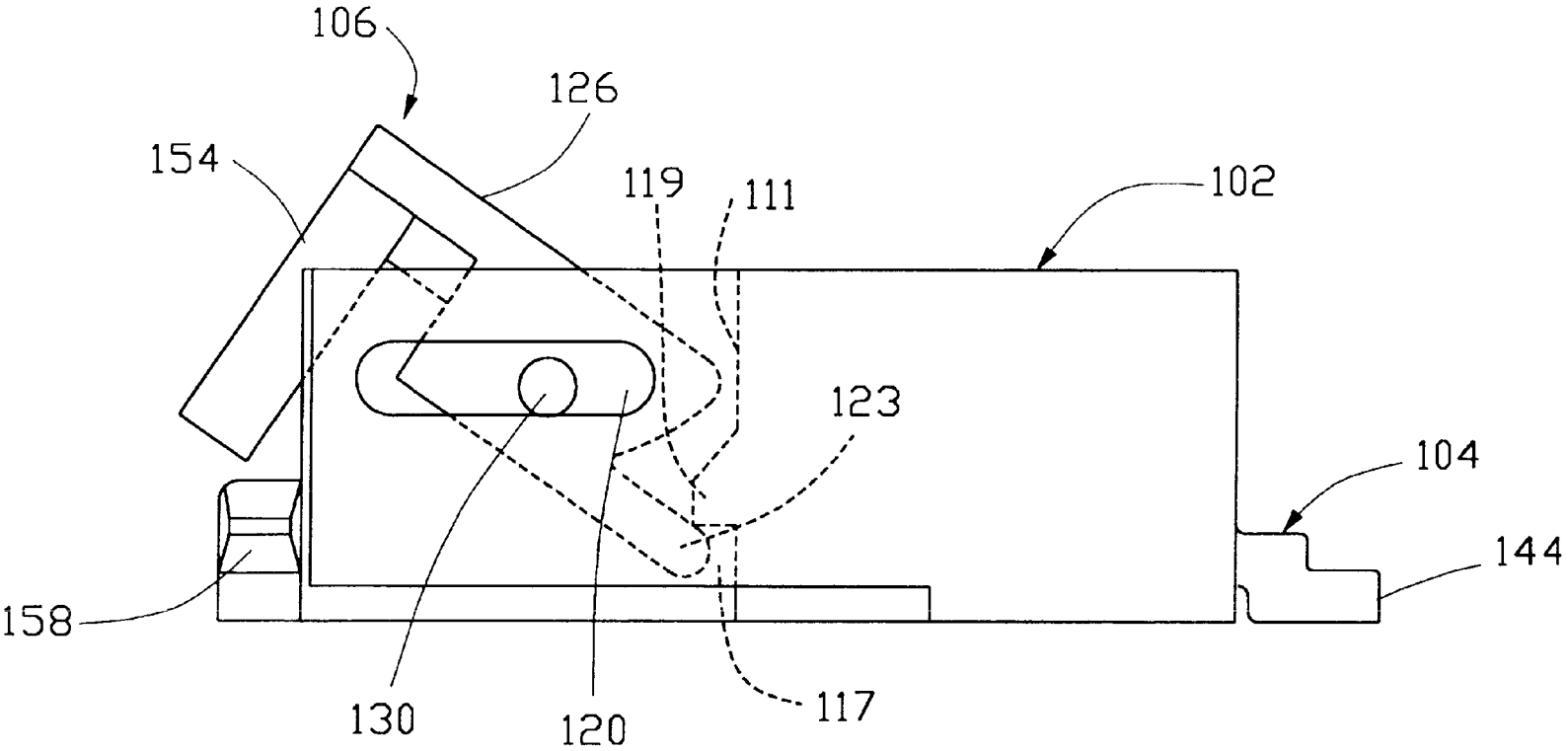
FIG. 7 is a side view of the flexible circuit connector of the present invention where the actuator is at the open position.
Figure 8:
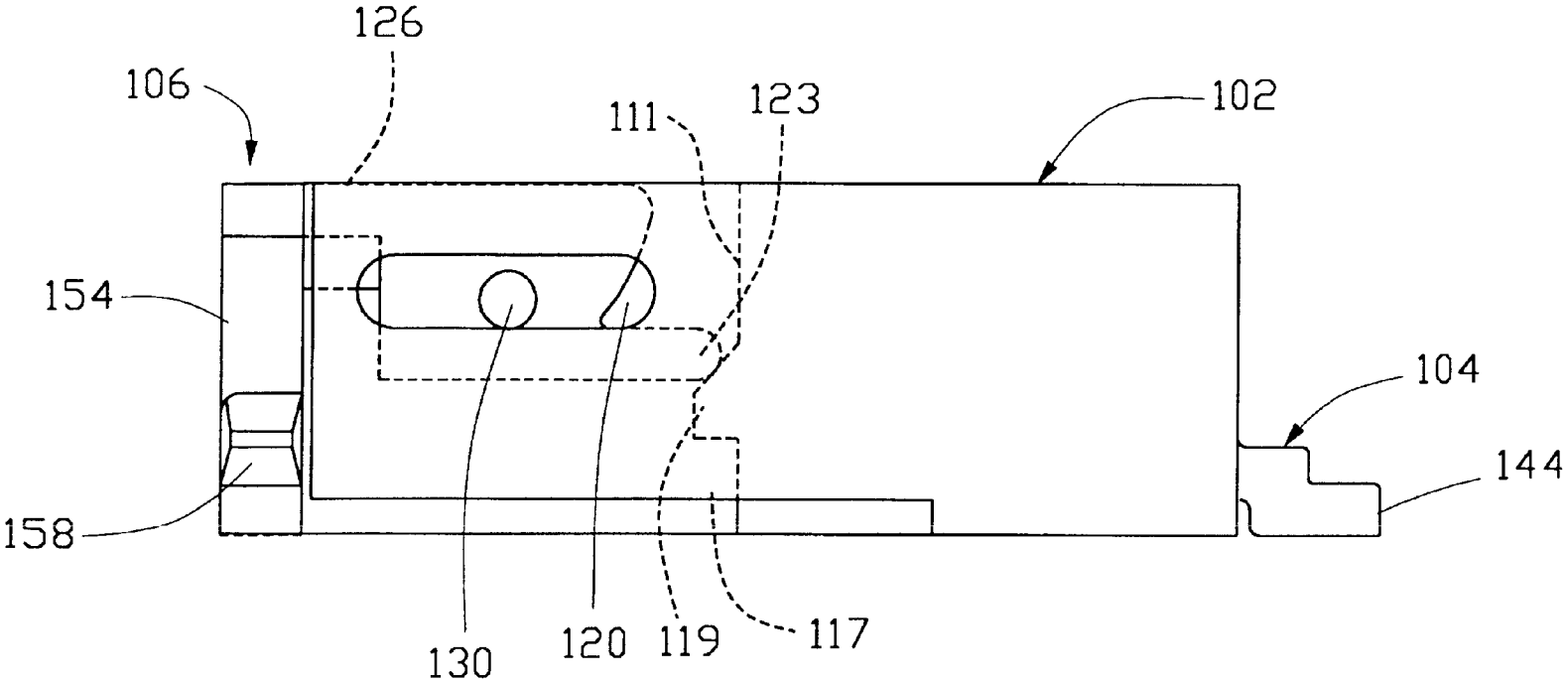
FIG. 8 is a side view of the flexible circuit connector of the present invention where the actuator is at the closed position.

Referring to FIG. 4 and FIG. 6, the actuator 106 comprises an elongate bar 124 with two arms 126 extending from opposite ends thereof and spaced there from by gaps 128. The arms 126 correspond to the sidewalls 112 of the housing 102 with a distance there between substantially corresponding to a distance between the inner side faces of the slits 115. A pivot pin 130 extends from an outside face of each arm 126 of the actuator 106 for being inserted into the pivot-receiving slot 120 of the corresponding sidewall 112 from the front end 121 of the housing 102. A pitch pin 123 is extended from an end of the arm 126 that can be received into the recess 117 for retaining the actuator 106 at certain position.

A pair of latching arms 154 extend from the bar 124 of the actuator 106 and each forms an inward projecting barb 156 for engaging with a corresponding notch 158 defined in the bottom wall 110 of the housing 102 for releasably fixing the actuator 106 at the closed position.

The contact 104 includes an engaging arm 138 and a tail section 144. The engaging arm 138 is received in the receiving groove 118 of the housing 102 and a convex portion 142 is formed on the front portion of the engaging arm 138. The tail section 144 extends from the housing 102 for connecting with printed circuit board.

During assembling, the actuator 106 is moved towards the housing 102 with two arms 126 extending into the slits 115 of the housing 102. As the spring arms 113 is elastic, when subjecting to a force acting by the pivot pins 130 on the arms 126, it will elastically deform and then will extend into the slits 115. Each pivot pin 130 will be received in the corresponding slot 120. The front end 121 of the inner spacer 103 is partly received into the groove 128 (see FIG. 3).

When the actuator 106 is at its open position, the flexible printed board is allowed to enter into the housing 102, and at the same time, the pitch pin 123 of the actuator 106 is accepted into the recess 117 of the housing 102 to secure the actuator 106 at certain position, so the actuator 106 will not move or vibrate easily. When closing the actuator 106, firstly, the pitch pin 123 is taken out from the recess 117 and the actuator 106 is pushed, the pivot pin 130 will then move along the slot 120 to make the actuator 106 close. The projecting barb 156 of the latching arms 154 engages with a corresponding notch 158 in the bottom wall 110 of the housing 102 for fixing the actuator 106 at the closed position.

Figure 9:
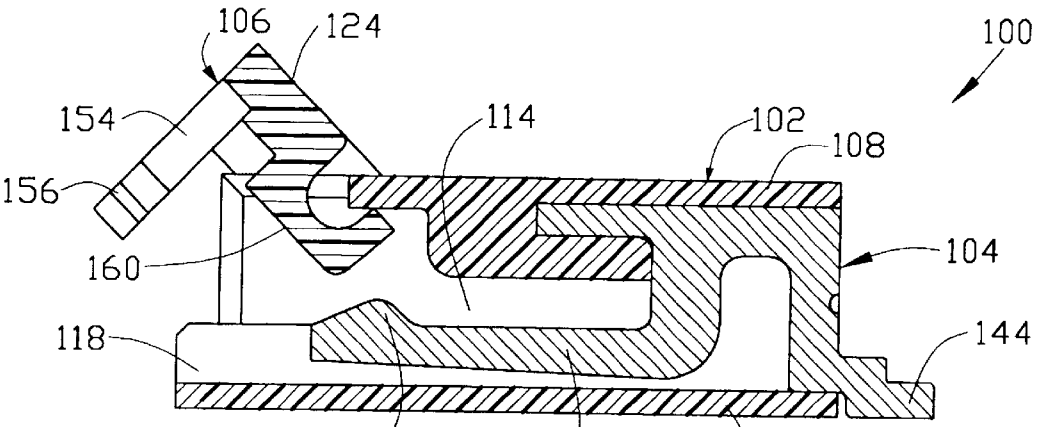
FIG. 9 is a cross-sectional view taken along line 9—9 of FIG. 2.
Figure 10:
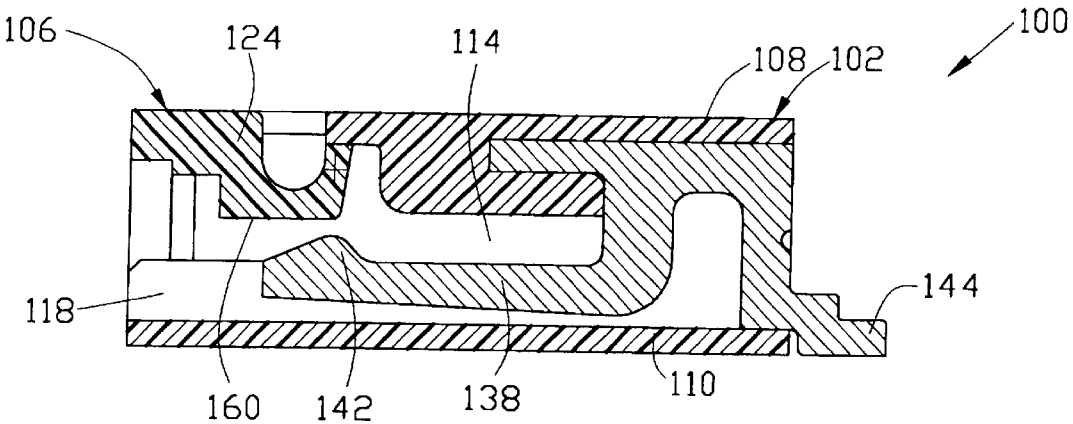
FIG. 10 is a cross-sectional view taken along line 10—10 of FIG.

Referring to FIG. 9 and FIG. 10, when the actuator 106 is at the open position, the flexible printed board is allowed to be accepted into the housing 102. The bar 124 of the actuator 109 has a pressure face 160 which opposes the convex portions 142 of the contacts 104 when the actuator 106 is at the closed position as shown in FIG. 5 whereby a flexible circuit (not shown) received in the connector 100 is secured between the pressure face 160 and the concave portions 142 of the contacts 104 and electrically engages with the contacts 104.

From the forgoing example, it will be appreciated that the actuator 106 is positioned by putting the pitch pin 123 into the recess 117 of the housing 102 at its open position, and engaging the projecting barb 156 with a corresponding notch 158 of the housing 102. It may be advantageous to construct a FPC connector of the present invention so that at least the connector can prevent the damage of the actuator 106 caused by undesirable movement at its open position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible printed circuit with a printed circuit board, comprising:

an insulative housing comprising two opposite side walls and an interior space formed there between for receiving a flexible circuit, a spring arm and an inner spacer formed on each side wall near each other, a slot formed in each spring arm to define a slit therebetween, a projection extending forward from a back surface of the slit, and a recess formed under each projection;

a plurality of contacts being secured in the housing, each contact having a contact portion extending into the interior space of the housing; and an actuator comprising an elongate bar and two side arms extending from opposite ends of the elongate bar, each side arm having a pivot pin inserted into the slot on the spring arm and a pitch pin received into the recess for maintaining the actuator at an open position;

wherein the pivot pin extends outwardly from each side arm of the actuator, the pitch pin extends rearwardly from the side arm;

further comprising a pair of notches located in the housing near the inner spacer and a pair of latching arms extending from the actuator, each latching arm forming an inwardly projecting barb for engaging with a corresponding notch;

wherein the contact also includes a tail section extending from the housing for connecting with the printed circuit board.

* * * * *